United States Patent [19]

Yamanaka et al.

[11] Patent Number: 4,647,732

[45] Date of Patent: Mar. 3, 1987

[54] DIGITAL SWITCH

[75] Inventors: Sekisuke Yamanaka; Akira Yanase, both of Takatsuki; Kiyotaka Hasegawa, Shiga; Takahiro Sakakino, Nagaokakyo, all of Japan

[73] Assignee: Omron Tateisi Electronics Co., Kyoto, Japan

[21] Appl. No.: 751,923

[22] Filed: Jul. 5, 1985

[30] Foreign Application Priority Data

| | | | |
|---|---|---|---|
| Jul. 4, 1984 | [JP] | Japan | 59-139549 |
| Jul. 6, 1984 | [JP] | Japan | 59-141044 |
| Jul. 9, 1984 | [JP] | Japan | 59-104248[U] |
| Jul. 12, 1984 | [JP] | Japan | 59-145825 |
| Jul. 25, 1984 | [JP] | Japan | 59-156290 |

[51] Int. Cl.[4] ..... H01H 3/34; H01H 21/80

[52] U.S. Cl. ..... 200/11 TW; 200/156

[58] Field of Search ..... 200/11 DA, 11 TW, 156, 200/291, 292, 6 B, 6 BA, 6 BB, 6 C, 153 P, 153 L

[56] References Cited

U.S. PATENT DOCUMENTS

| | | | |
|---|---|---|---|
| 3,723,674 | 3/1973 | Khitro et al. | 200/11 TW |
| 3,813,668 | 5/1974 | Ross | 200/11 TW X |
| 4,112,278 | 9/1978 | Greiner et al. | 200/11 TW X |
| 4,257,283 | 3/1981 | Haller et al. | 200/156 X |
| 4,464,549 | 8/1984 | Fujita | 200/11 TW X |
| 4,503,303 | 3/1985 | Fourcaulx et al. | 200/156 |

FOREIGN PATENT DOCUMENTS

| | | | |
|---|---|---|---|
| 2077499 | 12/1981 | United Kingdom | 200/156 |

*Primary Examiner*—J. R. Scott

*Attorney, Agent, or Firm*—Wegner & Bretschneider

[57] ABSTRACT

A digital switch may have an advantageous actuating member including, in addition to pawls for a ratchet mechanism, a pair of main bodies and spring portions integrally formed therewith, whereby the mechanical integrity of the actuating member and smooth operation are assured. The spring portions are interconnected by a mounting plate which is in turn engaged to a casing member. The switch may include an advantageous electro-conductive pattern which is made by insert molding an embossed metallic plate into synthetic resin, whereby the dimensional accuracy of the pattern is assured and the production may be facilitated. Further, the switching element may make use of a set of concentric cams which selectively drive movable contact pieces onto fixed contact pieces according to the stepwise rotation of a ratchet wheel.

11 Claims, 16 Drawing Figures

DIGITAL SWITCH

TECHNICAL FIELD

This invention relates to a digital switch for setting up numerical data and so on in electronic equipment in general, and in particular to a digital switch of a very simple and advantageous structure.

BACKGROUND OF THE INVENTION

Recently an increasingly large number of electronic devices are equipped with so-called digital switches for setting up values and parameters in place of conventional means such as potentiometers and so on which may be considered as analog set up means. A digital switch has the advantage that an input may be made in terms of discrete numbers. This development may be compared to the transition from slide rules to electronic calculators.

Since a digital switch requires an electric part which may be consisting of a more or less conventional switch element and a mechanical part which activates the switch element. The ratchet mechanism is most commonly used for such a mechanical part. Therefore, a digital switch is a fairly complex device and has been often too expensive for practical applications in spite of a strong demand for the use of digital switches.

Conventionally, a digital switch has been comprised of a case, a indicator wheel having a ratchet gear integrally formed therewith, a push rod having a pawl at its inner end so that the pawl may cooperate with the ratchet gear so as to turn the ratchet gear, along with the indicator wheel, in a step-wise manner. The indicator wheel is further connected to a switch element having movable contact pieces and fixed contact pieces which may be arranged in a pattern so as to produce a desired combination of output signals at the output terminals depending on the rotational angle of the indicator wheel.

Recently, development in micro-electronics has created a need for extremely compact design of digital switches, but, because of the basic mechanical complexity, there have been no digital switches which are of sufficient compact design and both economical and reliable. Following are some of the problems which engineers have encountered in designing such a digital switch.

First, because the ratchet and pawl mechanism requires a large number of component parts and, therefore, assembly work tends to be cumbersome and it is difficult to assure sufficient mechanical strength to each component part.

Secondly, a digital switch is generally equipped with a stopper mechanism which determines the range of the values which may be set up and, in order to indicate it to the user that a limit has been reached, the stopper mechanism must have a sufficient mechanical strength to withstand the force the user may apply to the digital switch without knowing that the limit has been reached. Conventional, pins are pressure fitted into the holes in the ratchet gear and the rotational limit of the indicator wheel has been determined by the engagement of the pins with a projection on a fixed member. However, as the size of the ratchet gear is reduced, it becomes difficult to obtain enough areas on the ratchet gear for fitting metallic pins thereinto with sufficient mechanical strength.

Thirdly, as the size of the digital switch is reduced, so the size of the switch element must be reduced. As a result, a small misalignment in the pattern of contact pieces may cause errors in the operation of the digital switch. Conventionally, printed circuit boards have been widely used as contact pieces having various patterns, but such printed circuits may lack necessary durability on one hand, and may lack sufficient dimensional precision on the other hand. Additionally, manufacturing a printed circuit requires special materials and special facilities, resulting in a relatively high cost for manufacture.

Alternatively, an electro-conductive pattern has been made by forming a V-groove corresponding to the pattern in the side surface of the circular base plate at the time of molding the same and pressure-fitting an electro-conductive member made of a printed circuit into the V-groove. However, because the electro-conductive pattern comprises a continuous contact surface having a circumferential portion, a radial portion and another concentric circumferential portion and a plurality of isolated contact surfaces, manual labor required for fitting the electro-conductive members into the V-grooves of the indicator wheel has been so substantial that it has been a major factor for the high cost of such a switch and increasingly compact design of switches tends to reduce the efficiency of such work.

OBJECT OF THE INVENTION

In view of such shortcomings of conventional digital switches, a primary object of this invention is to provide a digital switch of substantially compact design which is simple to assembly and durable.

Another object of this invention is to provide a digital switch which can operate in a smooth manner and is reliable.

Yet another object of this invention is to provide a digital switch equipped with a stopper mechanism which is compact enough to be accommodated in a digital switch of very compact design and strong enough to withstand rough handling.

SUMMARY OF THE INVENTION

In order to achieve such objects, according to this invention, there is provided a digital switch, comprising a indicator wheel supported in a freely rotatable manner and carrying symbols on its outer circumference, a ratchet gear formed on the indicator wheel in a coaxial manner, actuating means having pawls for rotating the ratchet wheel in step-wise manner by being operated by external force, and switching means connected to the indicator wheel so as to produce different signals on an output terminal depending on the rotational angle of the indicator wheel, wherein: the actuating means comprises a pair of substantially parallel main bodies, push-botton portions formed on first ends of the main bodies, a pair of advance pawls formed on free ends of a pair of first arms integrally extending from opposing surfaces of the main bodies toward the ratchet gear, a pair of stop pawls formed on free ends of a pair of second arms extending from the opposing sides of the main bodies towards the ratchet gear at an oblique angle relative to the main bodies, spring portions which are integrally formed on second ends of the main bodies, and a mounting member which interconnects the other ends of the spring portions and engaged to a fixed casing member.

According to a certain aspect of the invention, the indicator wheel is integrally provided with an outer ring and a stopper piece is fitted between the inner surface of the outer ring and the ratchet gear. The stopper piece may be adapted to cooperate with a stopper integrally formed in the casing member or, alternatively, to cooperate with part of the stop pawl.

According to another aspect of the invention, the indicator wheel comprises a main body made of molded synthetic resin, and a metallic member which is insert molded in the main body according to a desired electro-conductive pattern; and the contact unit comprises a plurality of contact pieces which cooperate with the electro-conductive pattern. It is even more preferable if the metallic member is a single plate which is embossed according to the desired electro-conductive pattern, elevated surfaces of the metallic plate being exposed for cooperation with the contact pieces of the contact unit while the depressed surfaces of the metallic plate is embedded in the main body made of synthetic resign so as to be insulated from the contact pieces of the contact unit.

Such an electro-conductive patterns is advantageously manufactured by a method comprising the steps of: forming the electro-conductive pattern by embossing an electro-conductive metal plate and forming a through hole in the bottom of an embossed depression, an embossed elevated surface serving as the isolated contact surface and the continuous contact surface; and inserting the metal plate into a mold forming cavity so that the electro-conductive pattern may come into contact with a die surface and performing insert molding by filling molten synthetic resin into a V-groove space between the two contact surfaces through the cavity and the through holes.

According to yet another aspect of the invention, the indicator wheel comprises a main body made of molded synthetic resin and cams formed integrally with the main body in a concentric partial arcuate manner on the side opposite to the ratchet gear; and the contact unit comprises at least one moveable contact piece which cooperates with the cams and at least one fixed contact piece connected to an output terminal, the moveable contact being biased away from the fixed contact piece and engageable to the fixed contact piece upon engagement with the cams.

BRIEF DESCRIPTION OF THE DRAWINGS

Now this invention is described in the following with reference to the appended drawings, in which:.

DESCRIPTION OF EMBODIMENTS

Figure 1:
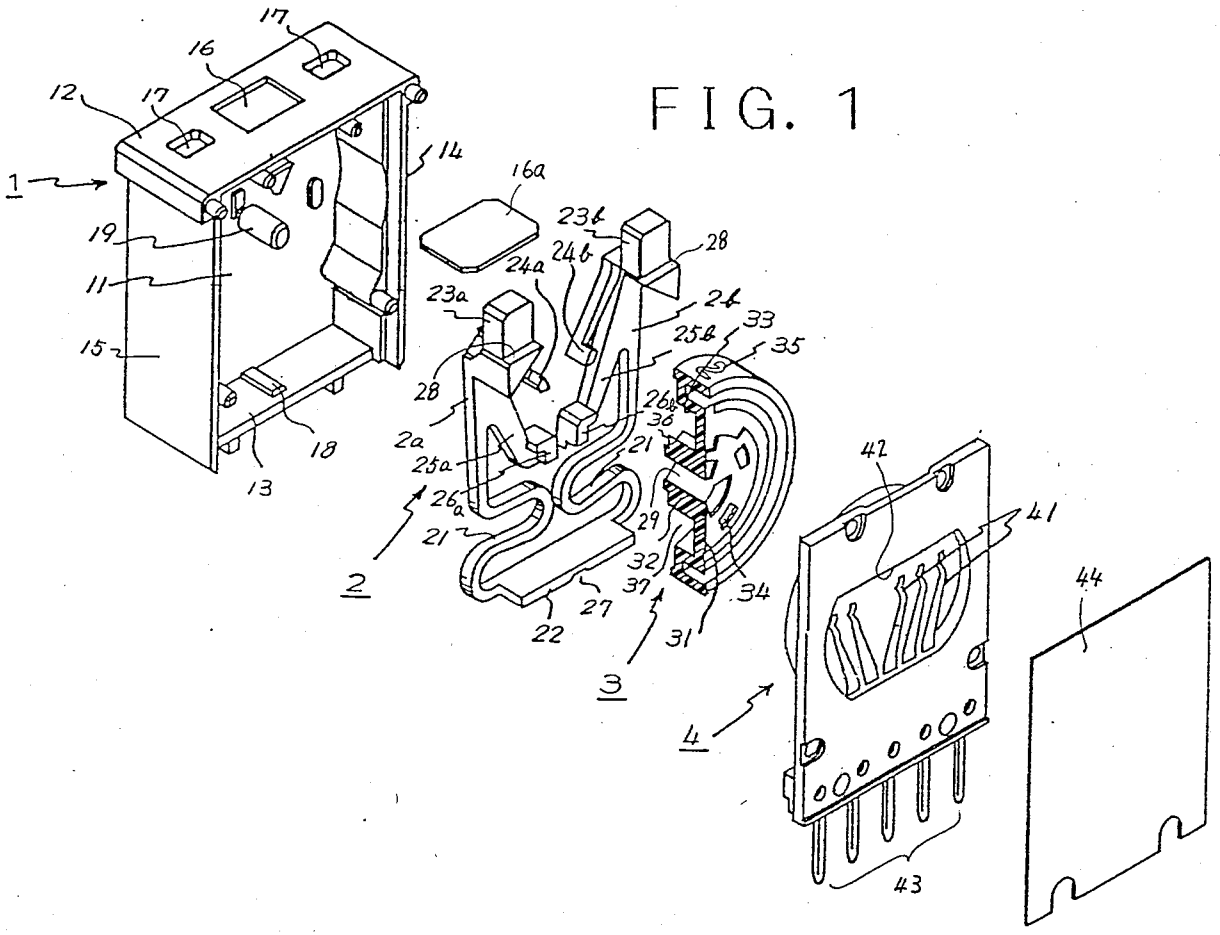
FIG. 1 is an exploded perspective view of an embodiment of the digital switch according to this invention.

FIG. 1 shows the internal structure of a digital switch according to this invention. This digital switch comprises a case 1 made of synthetic resin in the form of a rectangular box having an open end on one side thereof and includes a side wall 11 opposite to the open end, a front wall 12, a rear wall 13, a top wall 14 and a bottom wall 15.

The side wall 11 is provided with a pivot shaft 19 integrally formed therewith on its inner surface in a position which is generally in the middle but is slightly closer to the front wall 12. The front wall 12 has a display window 16 in its center fitted with a transparent acrylic plate 16*a* and a pair of through holes 17 above and below the display window 16 in symmetric manner. The rear wall 13 extends in parallel with the front wall 12 and has a linear projection 18 extending laterally in the middle part of its inner surface. The inner surfaces of the top and bottom walls 14 and 15 are conveniently contoured to accommodate internal structure.

A push rod member 2 comprises a pair of main body protions 2*a* and 2*b* extending generally in parallel with the top and the bottom walls 14 and 15, a pair of push-button portions 23*a* and 23*b* integrally formed on the front ends of the main body portions in a shape adapted to be passed through the through holes 17 of the front wall 12. The rear ends of the main body portions 2*a* and 2*b* are formed as spring portions 21 which are substantially U-shaped by curving towards each other and the rearmost ends of the spring portions 21 are joined together by a mounting plate 22 which is generally planar and extends in parallel with the rear wall 13. The rear surface of the mounting plate 22 is provided with a groove 27 which is adapted to snugly receive the linear projection 18 on the rear wall 13.

A pair of arms extend from the parts of the main body portions 2*a* and 2*b* adjacent to the push-botton portions 23*a* and 23*b* towards each other in an oblique manner, and the free ends of the arms are formed as advance pawls 24*a* and 24*b*. Another pair of arms 25*a* and 25*b* extend from the main body portions 2*a* and 2*b*, slightly rear to the first arms, in a manner similar to the first arms, and their free ends integrally carry stop pawls 26*a* and 26*b*, respectively.

Thus, the push rod member 2 integrally comprises the push-button portions 23*a* and 23*b*, the main body portions 2*a* and 2*b*, the advance pawls 24*a* and 24*b*, the stop pawls 26*a* and 26*b*, the spring portions 21 and the mounting plate, and is adapted to be fitted into the case 1 by passing the push-button portions 23*a* and 23*b* through the through holes 17 of the front wall from inside and engaging the groove 27 with the linear projection 18 of the rear wall 13. The push-button portions 23*a* and 23*b* thus protrude from the through holes 17 and shoulders 28 of the push-button portions determine the extent to which the push-button portions protrude from the front wall 12.

An indicator wheel 3 is generally shaped as a disc and is made of molded synthetic resin material. The indicator wheel 3 comprises a central pivot hole 29 which is adapted to be pivoted on the pivot shaft 19 of the side wall 11, a central tubular portion 32 surrounding the pivotal hole 29, a ratchet gear 36 formed on the free end of the tubular portion 32, and an outer ring 33 whose outer surface carries numerals 35 formed therein, for instance, by hot stamping.

When this indicator wheel 2 is pivoted on the pivot shaft 19, the numerals 35 on the outer circumferential surface show through the window 16 and the pawls 24*a*, 24*b*, 26*a* and 26*b* engage with the teeth of the ratchet gear 36 as will be described in greater detail hereinafter.

Figure 2:
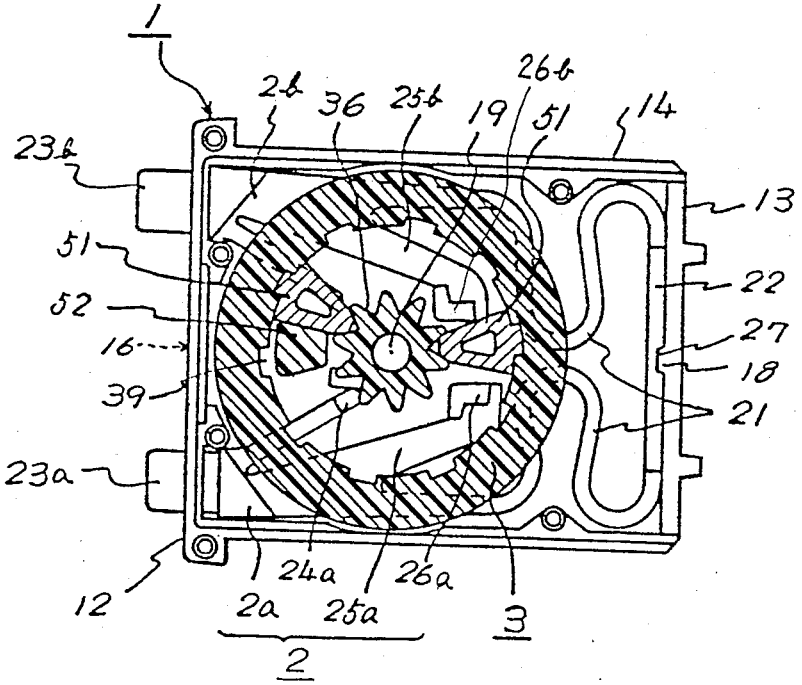
FIG. 2 is a sectional view of the digital switch of FIG. 1.
Figure 3:
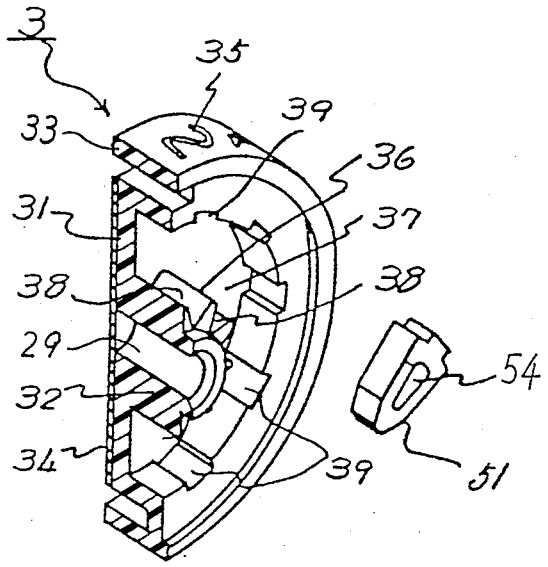
FIG. 3 is a partially broken away perspective view of the indicator wheel of the digital switch shown in FIGS. 1 and 2.

The side surface 31 of the indicator wheel 3 facing the open end of the case 1 carries an electro-conductive pattern 34 thereon. The inner surface of the outer ring 33 is provided with a number of notches 39 and a pair of stopper pieces 51 of a generally triangular cross-section are fitted into an annular space 37 defined between the central tubular portion 32 and the outer ring 33 by the broader ends of the stopper pieces 51 being engaged by the notches 39 of the outer ring 33 on one hand and the narrower ends of the stopper pieces 51 being engaged by grooves 38 between the teeth of the ratchet gear 36, as shown in FIGS. 2 and 3 in greater detail. These stopper pieces 51 define the range the indicator wheel 3 can rotate by engaging to a stopper 52 which is integrally formed on the side wall 11. As can be readily seen, these stopper pieces 51 may be inserted into the annular space 37 as desired and may be selectively placed therein according to the need of the user of the digital switch.

The axial length of these stopper pieces 51 is shorter than the axial length of the space 37 so that they do not interfere with the action of the pawls 24*a*, 24*b*, 26*a* and 26*b*. And they have axial through holes 54 so that they are elastic enough to be able to absorb any impulsive force they may receive upon contact with the stopper 52 and also to be snugly received between the ratchet gear 36 and the notches 39. These stopper pieces 51 have the additional utility as members for reinforcing the indicator wheel 3.

The open end of the case 1 is closed by a contact unit 4 consisting of a wall member having a central opening 42 and a plurality of terminals 43 in the rear end of the wall member. A plurality of contact pieces 41 are connected to the corresponding terminals 43 and project into the opening 42. These contact pieces 41 and terminals 43 are advantageously placed into the wall member by insert molding. When this contact unit 4 is fitted over the open end of the case 1, the contact pieces 41 engage the electro-conductive pattern 34 and can produce different electric signals on the terminals 43 depending on the angular position of the indicator wheel 2. The contact unit 4, when assembled, is further covered by a cover plate 44 for the protection of the contact pieces 41 from external interferences.

Figure 4:
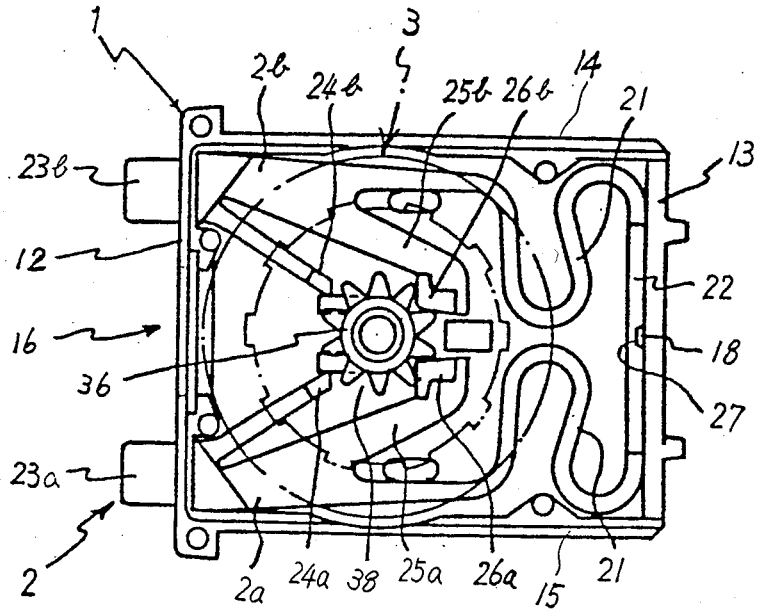
FIGS. 4 to 6 are plan views of the internal structure of the digital switch illustrating the action thereof.
Figure 5:
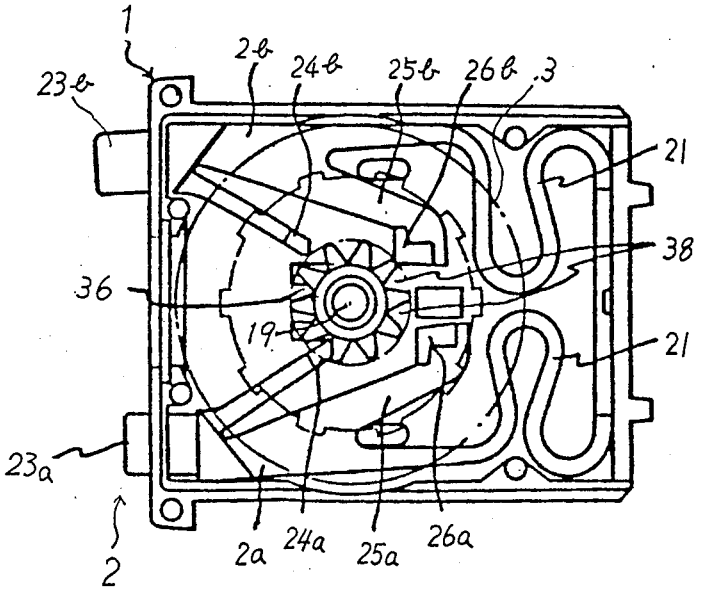
Figure 6:
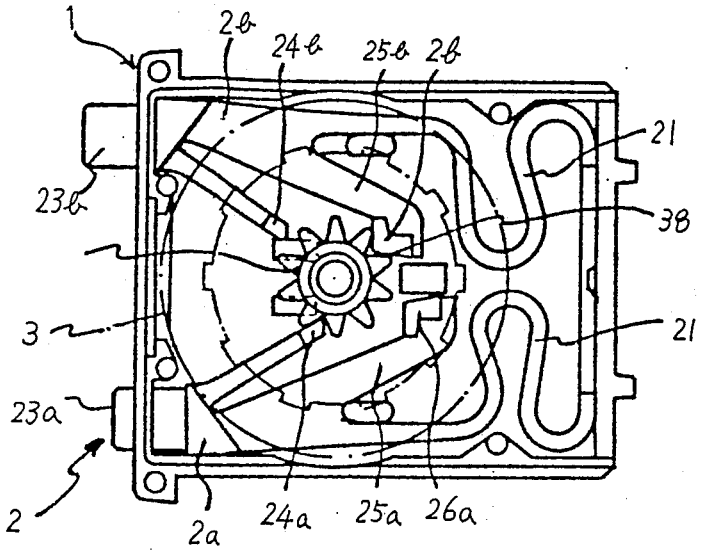

Now, the action of the above-described digital switch is described in the following with reference to FIGS. 4 to 6.

In the assembled state of the digital switch, the push rod member 2 is fitted into the case 1 by the engagements of the shoulder 28 with the front wall 12 and of the mounting plate 22 with the rear wall 13, and the push rod member 2 is so dimensioned that, in this assembled state, the spring portions 21 are slightly compressed. Therefore, the push rod member 2 is tightly fitted into the case 1 and is capable of withstanding vibrations without any play or looseness.

When either one of the push-button portions, for instance 23*a*, is depressed against the spring force of the corresponding spring portion 21, the stop pawl 26*a* comes out of the gear groove 38 and the advance pawl 24*a* pushes the ratchet gear 36 by one step. As the ratchet gear 36 rotates, the gear tooth pushes against the other stop pawl 26*b* but, due to the lateral flexibility of the arm 25*b*, the stop pawl 26*b* yields and rides over the gear tooth, as shown in FIG. 5.

As the push-button portion 31*a* is pushed further, the stop pawl 23*b* snugly fits into the next gear groove 38 under the biasing force produced from its own elasticity and holds the ratchet gear 36 at this position.

As a result, the indicator wheel 2 rotates by a predetermined angle and, by virtue of a suitable arrangement of the electro-conductive pattern, the contact pieces pick up a corresponding electric signal and produce it on the terminals 43. At the same time, the numeral which has been showing through the window 16 is now replaced by the next one.

When the push-button portion 23*a* is released, the main body portion 2*a* returns to its original position under the biasing force of the spring portion 21 and the stop pawl 26*a* fits into the next gear groove 38, thus firmly securing the ratchet gear 36 in cooperation with the other stop pawl 26*b*. Because the arms 25*a* and 25*b* is more rigid against the force directed from the front to the rear than the force directed from the bottom to the top or from the top to the bottom, the ratchet gear 36 is now very firmly secured.

The action is identical when the other push-button 23*b* is depressed but, of course, the ratchet gear 36 rotates in the reverse direction.

According to this invention, because it is the U-shaped and integral spring portions 21 which undergo deformation when the push-button portions 23*b*, 23*b* are depressed, the mounting plate 22 merely engages the case rear wall 13 without being deformed or displaced due to the positioning effect of the engagement between the linear projection 18 and the groove 27.

Figure 7:
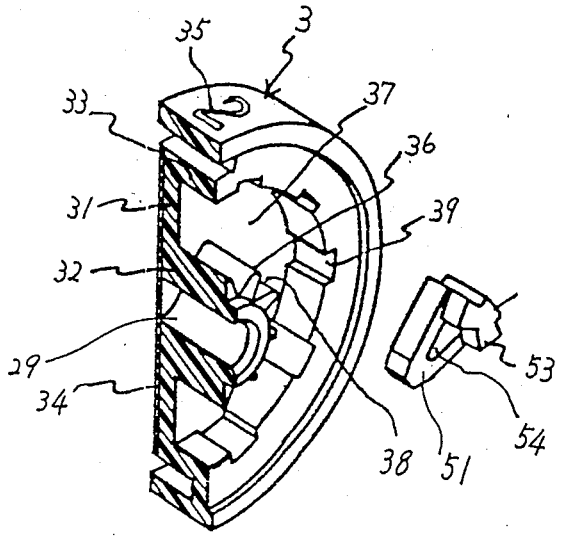
FIG. 7 is a view similar to FIG. 3 for showing another embodiment of the indicator wheel.
Figure 8:
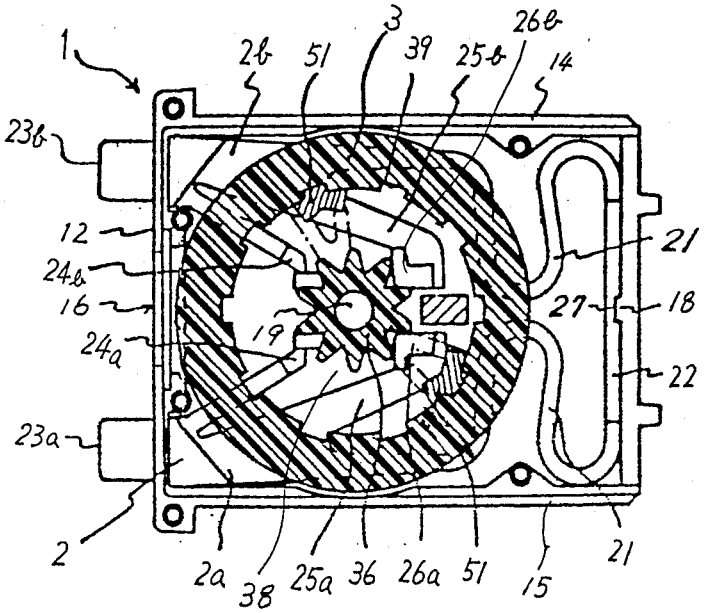
FIGS. 8 and 9 are views similar to FIGS. 4 to 6 for showing the action of a digital switch incorporating the indicator wheel of FIG. 7.
Figure 9:
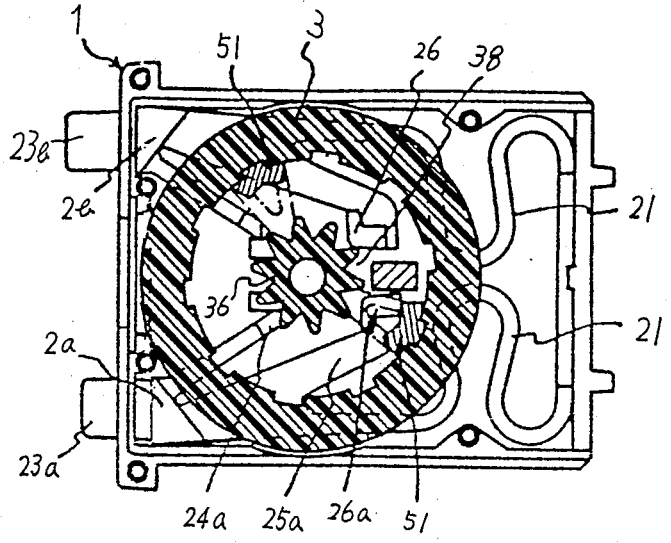
Figure 10:
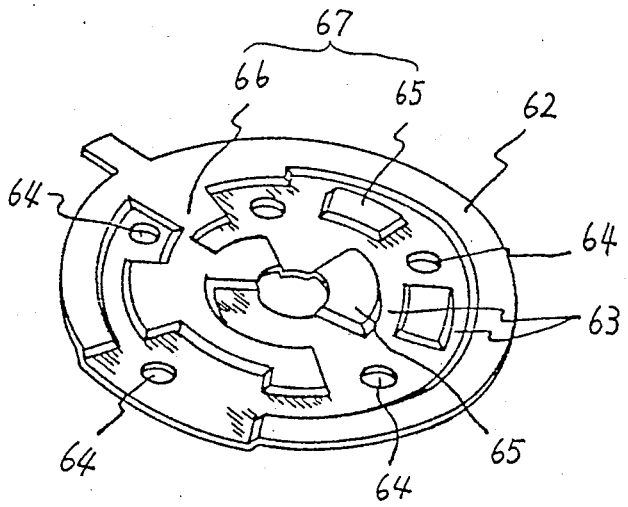
FIG. 10 is a perspective view showing an embodiment of an electro-conductive pattern which may be incorporated into the digital switch of this invention.
Figure 11:
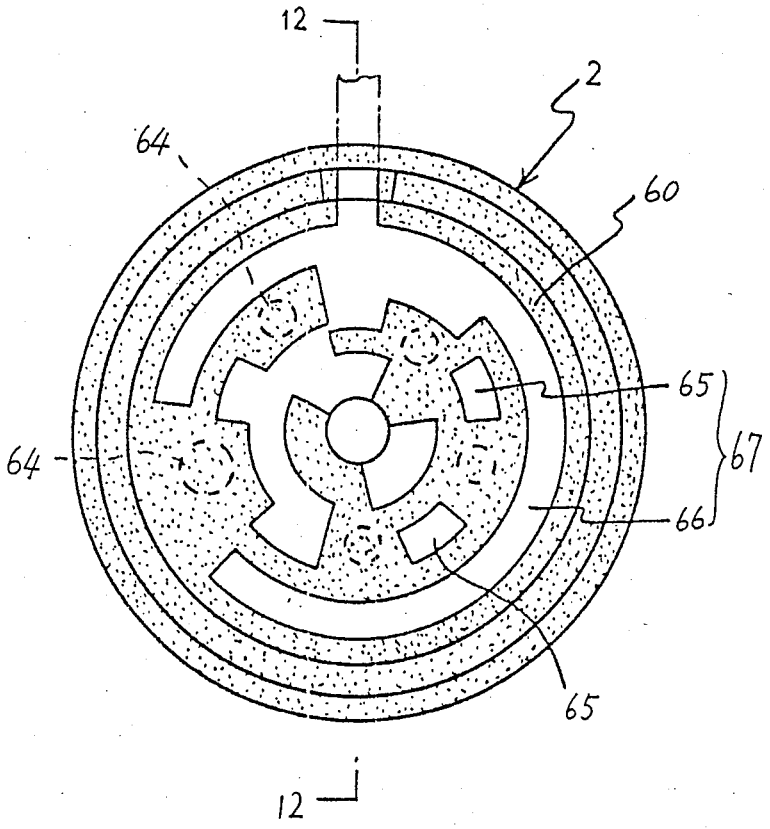
FIG. 11 is a front view of the indicator wheel carrying the electro-conductive pattern of FIG. 10.
Figure 12:
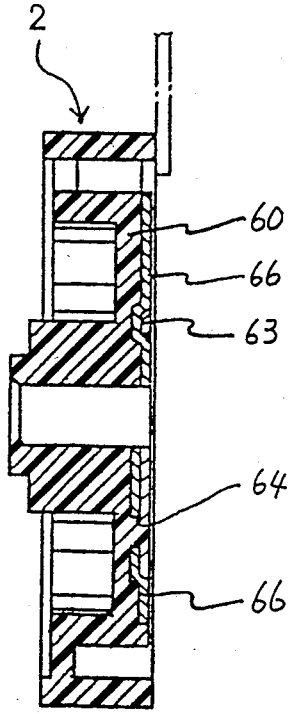
FIG. 12 is a sectional view taken along line 12—12 of FIG. 11.
Figure 13:
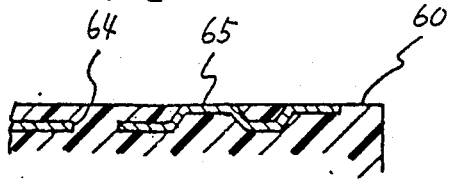
FIG. 13 is a magnified view of a part of FIG. 12.

FIG. 7 shows another embodiment of the stopper piece 51. An axial extension 53 is provided in the broader end or the end engaged by the notch 39 so that the mechanical strength of the engagement between the stopper piece 51 and the notch 39 may be increased. According to this embodiment, the stopper 52 is eliminated and when the limits of the rotation of the indicator wheel 3 are reached the axial extension 53 engage with the stop pawls 26*a* and 26*b* (FIGS. 8 and 9). The stopper pieces 51 otherwise do not interfere with the action of the pawls 24*a*, 24*b*, 26*a* and 26*b*.

FIGS. 10 to 13 show another embodiment of the electro-conductive pattern.

According to this embodiment, a desired pattern corresponding to the electro-conductive pattern to be formed is formed by the method of embossing, which may included a press-forming process, in an electro-conductive metal plate 62, and through holes 64 are formed in the bottoms of V-grooves 63 so that an electro-conductive pattern 67 may be formed from elevated surfaces serving as isolated contact surfaces 65 and V-grooves 63 serving as continuous contact surfaces 66. The metallic plate 62 is inserted into a cavity of a metallic molding die (not shown in the drawings) and molten synthetic resin is filled into the cavity including the V-groove space 63 between the two contact surfaces 65, 66 from the through holes 64. When the synthetic resin has solidified, the indicator wheel 3 having an electro-conductive pattern 67 on the base plate 60 is completed and the surface of the base plate 60 is flush with the surfaces of both the contact surfaces 65, 66.

This structure and the method of manufacture are quite advantageous because considerable saving of labor is achieved on one hand and the dimensional accuracy of the electro-conductive pattern 67 can be improved on the other hand. Additionally, the electro-conductive pattern 67 of this structure is mechanically highly integral and is indeed quite durable.

Figure 14:
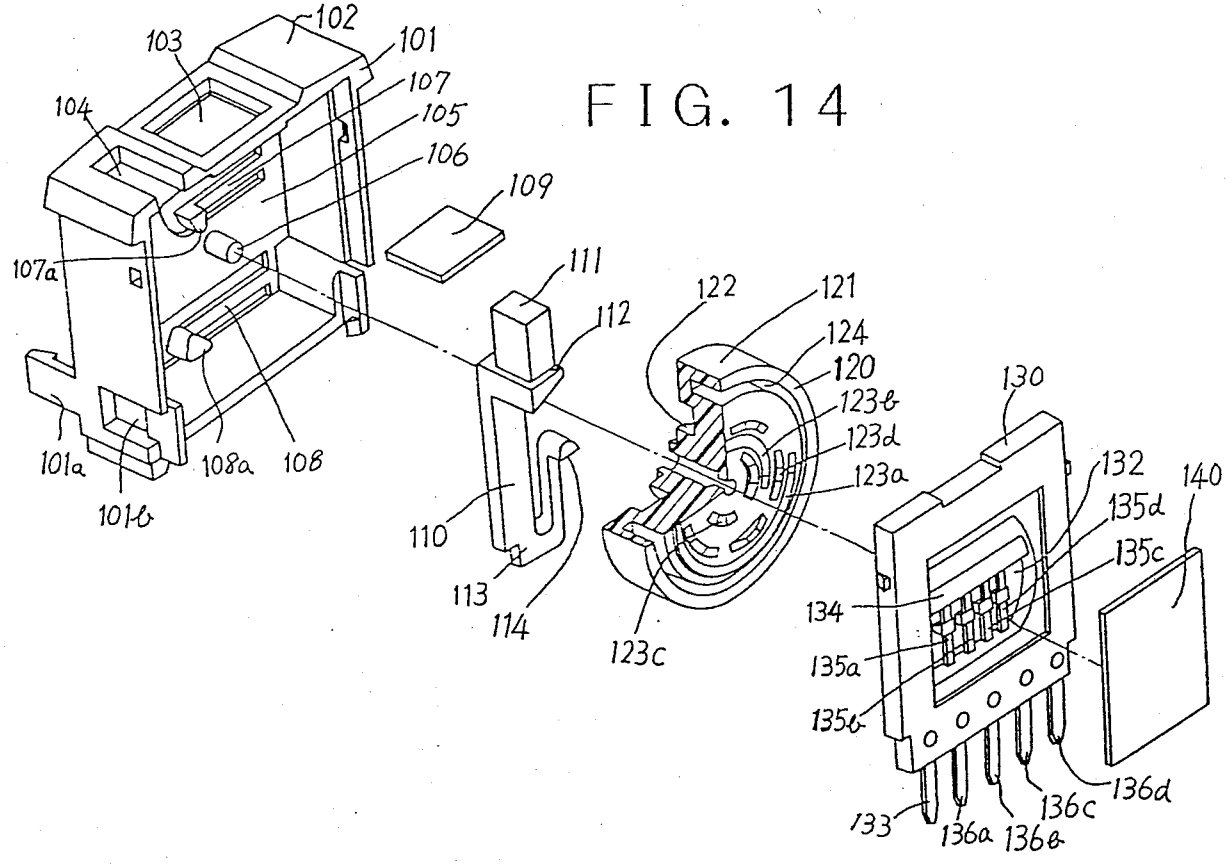
FIG. 14 is an exploded perspective view of another embodiment of the digital switch according to this invention.
Figure 15:
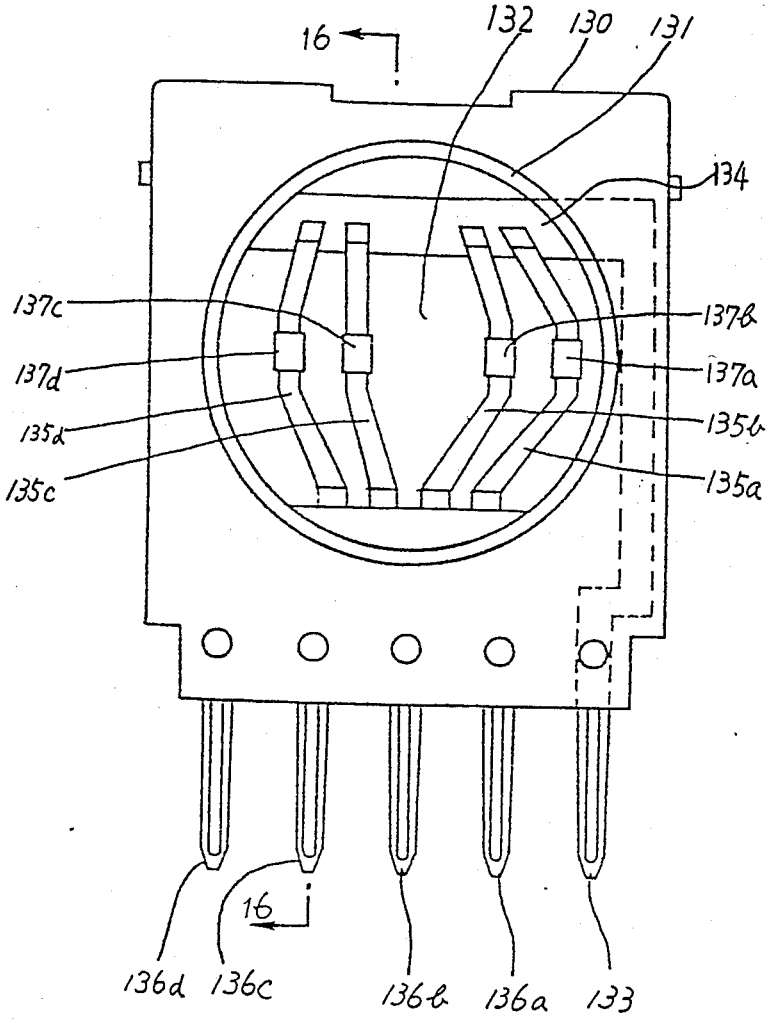
FIG. 15 is a front view of the contact unit used in the embodiment of FIG. 14.
Figure 16:
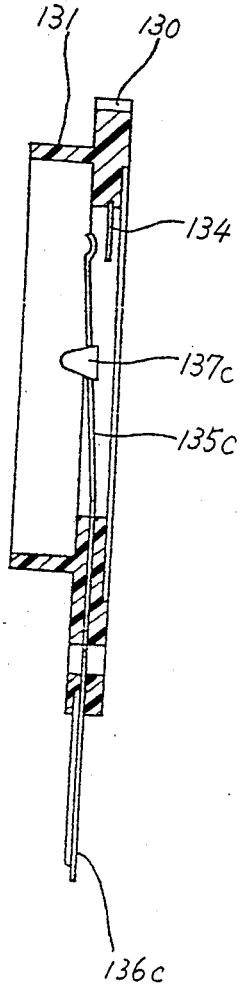
FIG. 16 is a sectional view taken along line 16—16 of FIG. 15.

FIGS. 14 to 16 show another embodiment of the digital switch of this invention.

According to this embodiment, the digital switch generally comprises a case 101, an actuating rod 110, a indicator wheel 120, a contact unit 130 and a case cover 140.

The case 101 is a box made of synthetic resin and is provided with a display window 103 and an actuating rod mounting hole 104 on its operating surface 102. Further, the case 101 is provided with a pivot shaft 106, for pivotally supporting the indicator wheel 120 as will be described in greater detail hereinafter, protruding from the center of a bottom surface 105 of the case 101 and a pair of springs 107, 108 are integrally formed in the bottom surface 105 so as to laterally oppose the pivot shaft 106 therebetween from below and above. The spring 107 is provided with a positioning pawl 107*a*, at its free end, which restrains the free rotation of a ratchet gear 122 by engaging thereto as will be described hereinafter while the spring 108 is provided with a protrusion 108*a*, at its free end, which engages the bottom surface of the actuating rod 110 to apply a restoring force thereto.

The display window 103 is fitted with a window cover 109, for instance, made of a transparent acrylic plate for shutting out dust and one can see the symbols on the indicator wheel 120 through this window 103.

Numerals 101*a* and 101*b* denote an engagement projection and an engagement hole, respectively, which are for connecting neighboring switches when the digital switches of this embodiment are used in a number more than one.

The actuating rod 110 has a push-button portion 111 protruding from the mounting hole 104 of the case at its upper end and a drive portion 113 which is shaped as latter "U" and formed integral with a drive pawl 114 on the free end at its lower end. When this actuating rod 110 is pushed down, the drive pawl 114 advances the ratchet gear 122 in a step-wise manner. The proximal end of the push-button portion 111 is provided with a stopper surface 112 for determining the uppermost position of the push-button portion 111.

The indicator wheel 120 is shaped as a disc carrying numerals or letters on its outer circumferential surface 121 which are formed, for instance, by hot stamping at equal intervals and supported by the pivot shaft 106 in a freely rotatable manner. One side of the indicator wheel 120 is provided with the ratchet gear 122, as mentioned previously, which may be rotated in a step-wise manner by the drive portion 113, and the other side of the indicator wheel 120 is provided with cam portions 123*a* to 123*d* on concentric circles of different diameters so as to correspond to the numerals, surrounded by an annular groove 124.

The contact unit 130 has a contour which is adapted to close the case 101, and an annular projection 131, which fits into the annular groove 124, is integrally provided in the inner side surface of the contact unit 130, with a central opening 132 being formed in the center of the annular groove 131. This central opening 132 accommodates a fixed contact piece 134 formed integral with a common terminal 133 and moveable contact pieces 135*a* to 135*b* formed integral with corresponding terminals 136*a* to 136*d* and in contact with the cam portions 123*a* to 123*d*, these contact pieces being accurately positioned by insert molding.

Contact portions 137*a* to 137*d* which are to contact the cam portions 123*a* to 123*d* are integrally formed with the moveable contact pieces 135*a* to 135*d* by being made of synthetic resin (FIGS. 15 and 16). The moveable contact pieces 135*a* to 135*d* may be made by press-forming or bending, but, because of the difficulty to obtain required dimensional accuracy, performance may be impaired and adjustment work during assembly may be too cumbersome. However, according to this embodiment, dimensional accuracy is very favorable and no adjustment is required during assembly.

The case cover 140 is attached over the outer surface of the contact unit 130 to close the central opening 132.

Now the action of the digital switch of the above described structure is described in the following:

First, when the push-button portion 111 of the actuating rod 110 is pushed down and the actuating rod moves downwardly against the biasing force of the spring 108, the drive pawl 114 engages with a tooth of the ratchet gear 122, and the indicator wheel 120 integral with the ratchet gear 122 is rotated. When the positioning pawl 107*a* of the spring 107 has come off the corresponding tooth as the ratchet wheel 122 turns, then the positioning pawl 107*a* again engages with the space between the next two teeth under its restoring force, thus preventing any further rotation of the ratchet gear 122. Therefore, the indicator wheel 120 turns by one step and then stops at that position.

When the pressure on the push-button portion 111 is removed, the actuating shaft 110 restores its original position under the biasing force of the spring 108 and disengages from the teeth of the ratchet gear 122.

Every time this is repeated, the ratchet gear 122 along with the indicator wheel 120 rotates by one step and the numeral showing in the display window 103 through the transparent window cover 109 increases by one. At the same time, the cam portion 123*a* to 123*d* corresponding to the displayed numeral engages the corresponding contact portion 137*a* to 137*d* and brings the moveable contact pieces 135*a* to 135*d* into engagement with the fixed contact piece 134 to produce a signal corresponding the displayed numeral.

Thus, according to the digital switch of this embodiment, a cam portion is insert molded on one side of a symbol wheel in place of a conventional printed circuit board while a contact portion for engagement with the cam portion is insert molded on a moveable contact piece in place of a conventional metallic member, by doing so, much higher dimensional accuracy has become possible as opposed to the case in which a conventional printed circuit board is used and, therefore, a digital switch of more accurate performance can be obtained.

Furthermore, elimination of the work required for positioning a printed circuit board greatly simplifies the manufacturing process. Moreover, elimination of an expensive printed circuit board can provide a digital switch having a low cost contact mechanism.

This invention may be applied not only to digital switches as described above, but also to other electric component parts, such as switches, and has practical advantages.

Although the present invention has been shown and described with reference to the preferred embodiments thereof, it should not be considered as limited thereby. Various possible modifications and alterations could be conceived of by one skilled in the art to any particular embodiment, without departing from the scope of the invention. Therefore, it is desired that the scope of this invention should be defined not by any of the perhaps purely fortuitous details of the shown preferred embodiments, or of the drawings, but solely by the scope of the appended claims, which follow.

What we claim is:

1. A digital switch, comprising a indicator wheel supported in a freely rotatable manner and carrying symbols on its outer circumference, a ratchet gear formed on the indicator wheel in a coaxial manner, actuating means having pawls for rotating the ratchet wheel in step-wise manner by being operated by external force, and switching means connected to the indicator wheel so as to produce different signals on an output terminal depending on the rotational angle of the indicator wheel, wherein:

the actuating means comprises a pair of substantially parallel main bodies, push-button portions formed on first ends of the main bodies, a pair of advance pawls formed on free ends of a pair of first arms integrally extending from opposing surfaces of the main bodies toward the ratchet gear, a pair of stop pawls formed on free ends of a pair of second arms extending from the opposing sides of the main bodies towards the ratchet gear at an oblique angle relative to the main bodies, spring portions which are integrally formed on second ends of the main bodies, and a mounting member which interconnects the other ends of the spring portions and is engaged to a fixed casing member.

2. A digital switch as defined in claim 1, wherein the spring portions consist of "U" bends formed as integral extensions of the main bodies and bending toward each other.

3. A digital switch as defined in claim 2, wherein the mounting member is a plate having a means for detachable engagement with the casing member.

4. A digital switch as defined in claim 3, wherein the actuating member is made of integrally molded synthetic resin.

5. A digital switch as defined in claim 4, wherein the indicator wheel is integrally provided with an outer ring and a stopper piece is fitted between the inner surface of the outer ring and the ratchet gear.

6. A digital switch as defined in claim 5, wherein the stopper piece cooperates with a stopper integrally formed in the casing member.

7. A digital switch as defined in claim 5, wherein the stopper piece cooperates with part of the stop pawl.

8. A digital switch, comprising a indicator wheel supported in a freely rotatable manner and carrying symbols on its outer circumference, a ratchet gear formed on the indicator wheel in a coaxial manner, actuating means having pawls for rotating the ratchet wheel in step-wise manner by being operated by external force, and a contact unit connected to the indicator wheel so as to produce different signals on an output terminal depending on the rotational angle of the indicator wheel, wherein:

the actuating means comprises a pair of substantially parallel main bodies, push-button portions formed on first ends of the main bodies, a pair of advance pawls formed on free ends of a pair of first arms integrally extending from opposing surfaces of the main bodies toward the ratchet gear, a pair of stop pawls formed on free ends of a pair of second arms extending from the opposing sides of the main bodies towards the ratchet gear at an oblique angle relative to the main bodies, spring portions integrally formed on second ends of the main bodies, a mounting member which interconnects the other ends of the spring portions and is engaged to a fixed casing member;

the indicator wheel comprises a main body made of molded synthetic resin, and a metallic member which is insert molded in the main body according to a desired electro-conductive pattern; and the contact unit comprises a plurality of contact pieces which cooperate with the electro-conductive pattern.

9. A digital switch as defined in claim 8, wherein the metallic member is a single plate which is embossed according to the desired electro-conductive pattern, elevated surfaces of the metallic plate being exposed for cooperation with the contact pieces of the contact unit while the depressed surfaces of the metallic plate is embedded in the main body made of synthetic resign so as to be insulated from the contact pieces of the contact unit.

10. A digital switch, comprising a indicator wheel supported in a freely rotatable manner and carrying symbols on its outer circumference, a ratchet gear formed on the indicator wheel in a coaxial manner, actuating means having pawls for rotating the ratchet wheel in step-wise manner by being operated by external force, and switching means cooperating with the indicator wheel so as to produce different signals on an output terminal depending on the rotational angle of the indicator wheel, wherein:

the indicator wheel comprises a main body made of molded synthetic resin and cams formed integrally with the main body in a concentric partial arcuate manner on the side opposite to the ratchet gear;

the switching means comprising at least one moveable contact piece which cooperates with the cams and at least one fixed contact piece connected to an output terminal, the moveable contact being biased away from the fixed contact piece and engagable to the fixed contact piece upon engagement with the cams; and wherein the moveable contact piece carries a contact member made of synthetic resin for contact with the cams.

11. A digital switch as defined in claim 10, wherein the moveable contact, the fixed contact and the terminal are insert molded into a contact unit made of synthetic resin.

* * * * *